US006085807A

United States Patent [19]

Wright

[11] Patent Number: 6,085,807

[45] Date of Patent: Jul. 11, 2000

[54] CONSTANT DROP TABLET RECEPTACLE

[75] Inventor: Nigel P. Wright, Marion, Iowa

[73] Assignee: Vector Corporation, Marion, Iowa

[21] Appl. No.: 09/326,763

[22] Filed: Jun. 4, 1999

[51] Int. Cl.[7] ..... B65B 1/04

[52] U.S. Cl. ..... 141/114; 141/10; 141/314; 220/495.01

[58] Field of Search ..... 141/10, 114, 313–317; 220/495.01

[56] References Cited

U.S. PATENT DOCUMENTS

| | | | |
|---|---|---|---|
| 192,652 | 7/1877 | Moule . | |
| 399,373 | 3/1889 | Bradshaw et al. . | |
| 957,652 | 5/1910 | Bush . | |
| 1,276,453 | 4/1918 | Tussing . | |
| 1,359,586 | 11/1920 | Flagg . | |
| 1,558,169 | 10/1925 | Hume . | |
| 3,924,781 | 12/1975 | Witte . | |
| 4,167,235 | 9/1979 | Green . | |
| 4,749,106 | 6/1988 | Von Schuckmann et al. . | |
| 4,763,815 | 8/1988 | Von Schuckmann et al. . | |
| 5,033,706 | 7/1991 | Poulton . | |
| 5,165,455 | 11/1992 | De Crane | 141/10 |
| 5,344,109 | 9/1994 | Hokoana, Jr. . | |
| 5,439,036 | 8/1995 | Kramer | 141/1 |
| 5,582,219 | 12/1996 | Claar et al. | 141/93 |
| 5,787,945 | 8/1998 | Riemersma . | |

*Primary Examiner*—Steven O. Douglas
*Attorney, Agent, or Firm*—Zarley, McKee, Thomte, Voorhees & Sease

[57] ABSTRACT

A receptacle is provided for receiving soft fragile tablets from a tablet press. The receptacle includes a drum with a soft bag mounted therein. The bag is supported by a suspension system which automatically lowers the bag from an empty raised position to a loaded lower position, in response to the weight of the tablets in the bag. The suspension system maintains a constant drop distance for the tablets between the discharge chute of the tablet press and the bag, thereby minimizing damage to the tablets during the transfer process. The bag is porous to permit air treatment for hardening of the tablets after the tablets are received in the bag.

20 Claims, 5 Drawing Sheets

CONSTANT DROP TABLET RECEPTACLE

BACKGROUND OF THE INVENTION

Tablets are typically made in a tableting press that compresses the tablet ingredients into the tablet form and then discharges the tablets into a container or receptacle. The hardness or softness of the tablets is depended upon the composition of the tablets. Soft, fragile tablets are often treated in the container with conditioned air so as to harden the tablet. However, damage, including breakage, may occur as the tablet is transferred from the press to the container. Such damage results from tablet to container collisions, as well as tablet to tablet collisions, as the tablet is dropped from the press into the container. Normally, damaged tablets must be discarded.

Accordingly, a primary objective of the present invention is the provision of an improved receptacle for receiving tablets from a tablet press.

Another objective of the present invention is an improved method of transferring tablets from a tablet press to a receptacle.

A further objective of the present invention is the provision of a tablet receptacle and tablet transfer method that maintains a constant drop distance for the tablets between the tablet press and the receptacle.

A further objective of the present invention is a provision of a constant drop tablet receptacle that allows further treatment of the tablets.

Another objective of the present invention is a provision of a tablet receptacle having a volume which increases as additional tablets are received therein.

A further objective of the present invention is the provision of a tablet receptacle that is durable and effective in use, and economical to manufacture.

These and other objectives will become apparent from the following description of the invention.

SUMMARY OF THE INVENTION

A tablet receptacle is provided for receiving tablets from a tableting press. The receptacle includes a drum in which tablets may be treated. A porous bag or net has a perimeter edge secured to the upper perimeter of the drum. The center of the bag is supported by a spring suspension system so as to define an annular trough for gently receiving tablets from the tablet press. As additional tablets are received in the bag, the spring suspension system automatically extends to lower the center of the bag, thereby lowering the annular trough and increasing the volume of the trough, thereby maintaining a constant drop distance between the press and the bag. Accordingly, the number and severity of tablet to receptacle and tablet to tablet collisions is minimized. A flap is provided on the bottom of the bag for discharging tablets from the bag.

To facilitate distribution of the tablets in the trough, the drum and secured bag may be rotated, or a vibrator may be provided to enhance settlement of the tablets in the trough of the bag. Another option is to provide a swivel distribution on the discharge chute of the tablet press. A further alternative is to rotatably mount the bag upon the drum.

The method of the present invention involves discharging tablets from the tablet press into the bag which is supported in the drum at a preset depth. The depth of the bag is automatically increased in the drum as additional tablets are received in the bag, thereby maintaining a constant drop distance for the tablets. As the bag moves from its empty raised position to the full lowered position, the volume of the bag increases to accommodate additional tablets.

DETAILED DESCRIPTION OF THE DRAWINGS

Figure 4:
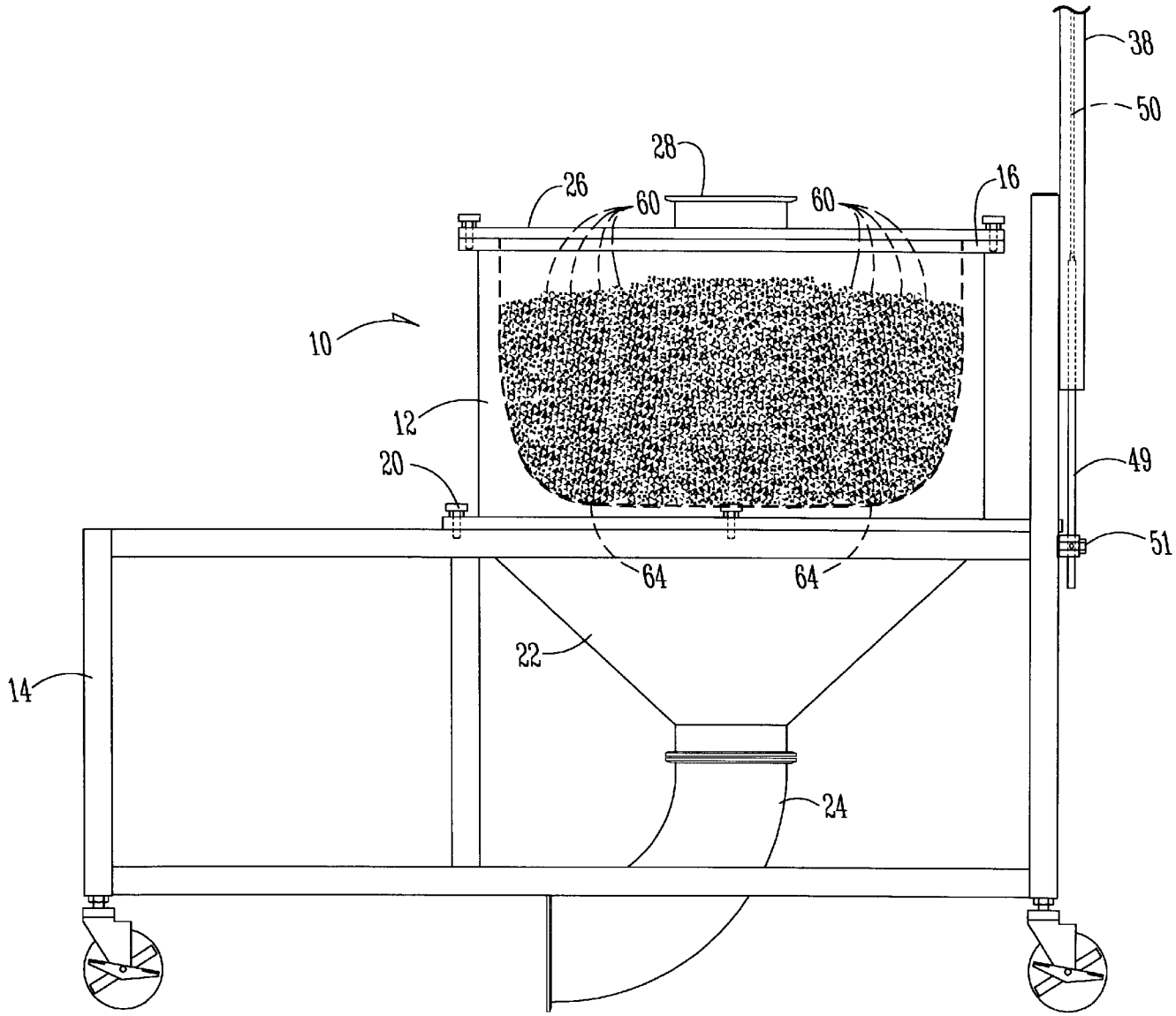
FIG. 4 is a side elevation view of the drum rotated 90° from FIGS. 1–3, and with a lid on the drum for a tablet treatment process.

A tablet receptacle according to the present invention is generally designated in the drawings by the referenced numeral 10. The receptacle includes a drum 12 mounted on a wheeled frame 14. The drum includes an upper perimeter flange 16 and a lower perimeter flange 18 for mounting the drum 12 on the frame 14 via thumbscrews 20. Removably secured to the bottom of the drum 12 is a conical section 22 which terminates in an air duct 24. A lid 26 is removably mountable upon the upper flange 16, as shown in FIG. 4, and includes an air vent 28. After tablets are received in the receptacle 10, as described below, the tablets can be treated with conditioned air so as to harden the tablets.

The structure of the drum 12 and the frame 14 is conventional.

Figure 5:
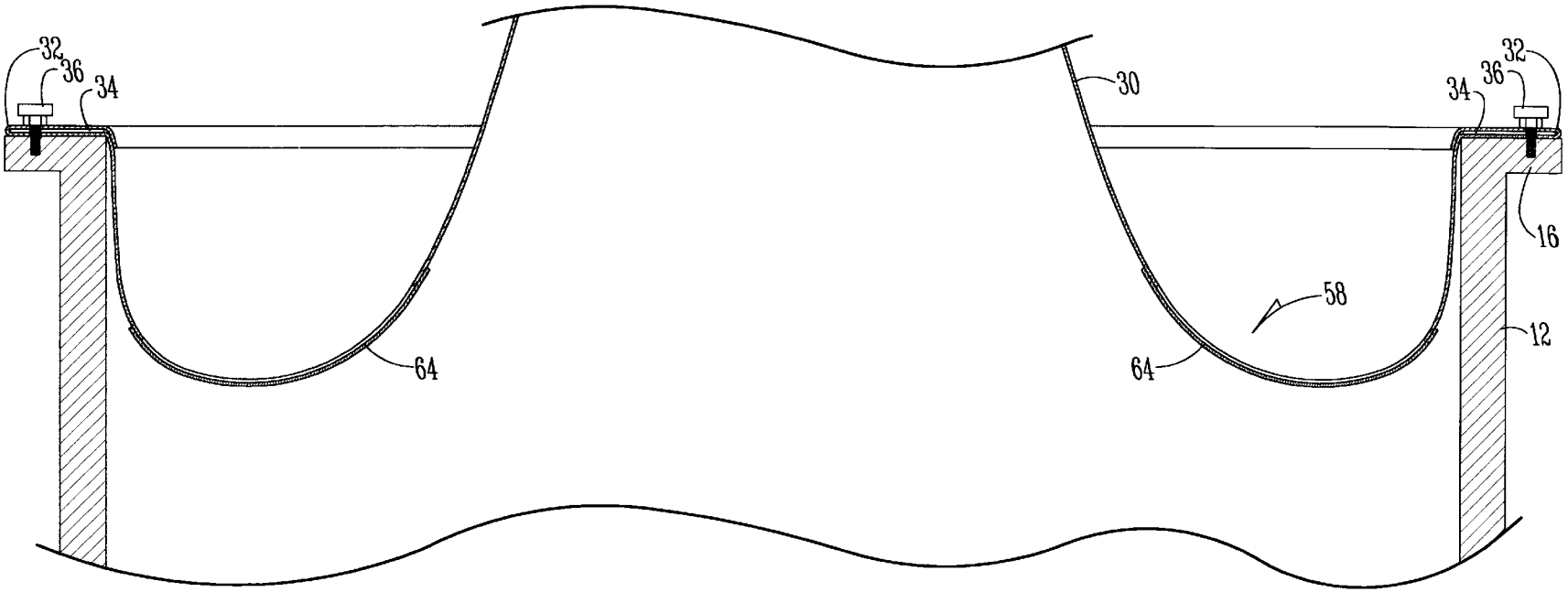
FIG. 5 is an enlarged sectional view taken along lines 5—5 of FIG. 1.

A porous bag 30 is secured in the drum 12. More particularly, as seen in FIG. 5, the bag 30 includes a perimeter pocket or cuff 32 which is sewn or otherwise secured around a ring 34. The ring 34 includes apertures through which thumbscrews 36 extend for mounting the bag 30 to the upper flange 16 of the drum 12.

Figure 1:
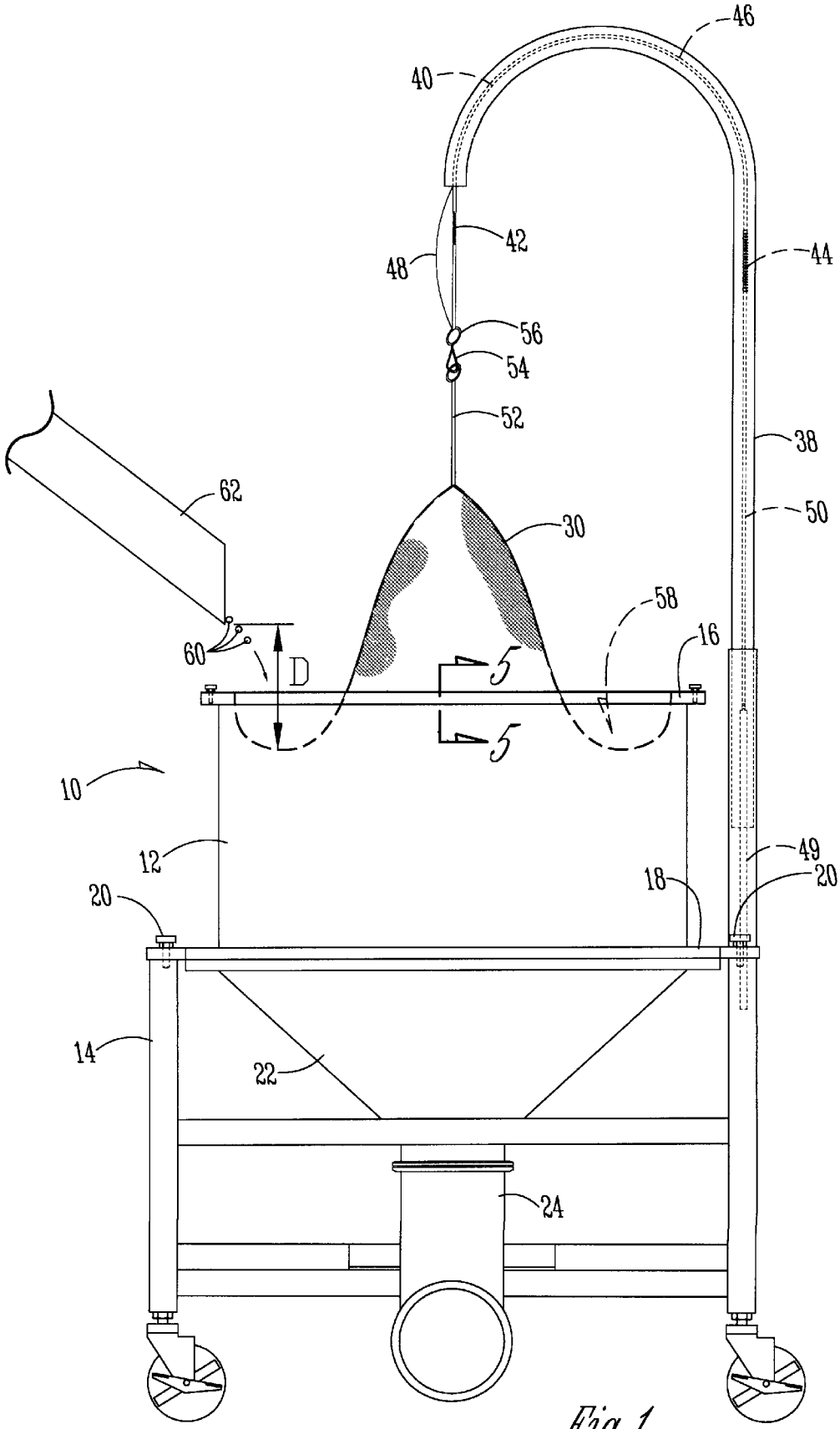
FIG. 1 is a side elevation view of the constant drop tablet receptacle of the present invention, including a discharge chute from a tablet press, with the bag shown positioned in an empty raised position.
Figure 2:
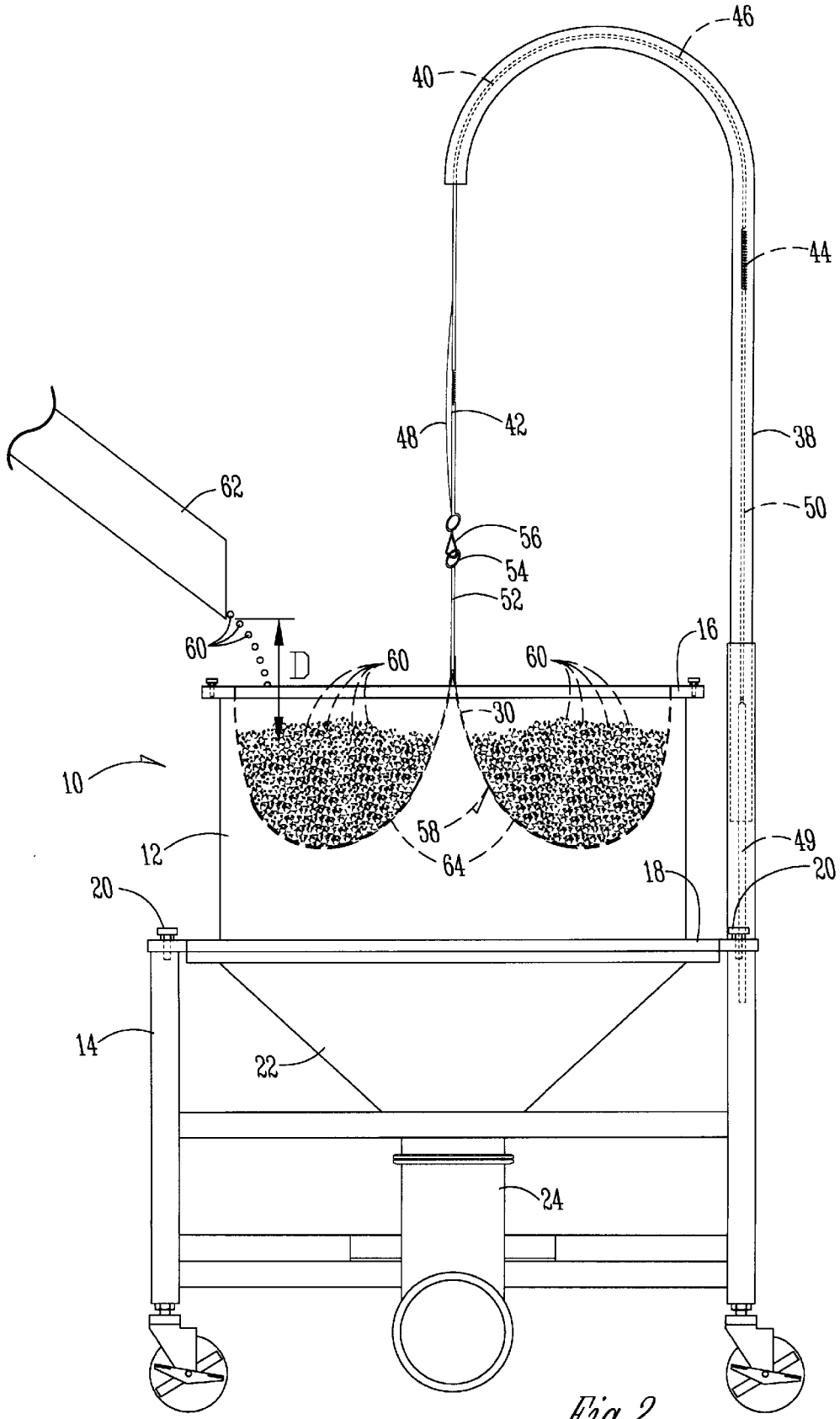
FIG. 2 is a view similar to FIG. 1 showing the bag in a partially loaded intermediate position.
Figure 3:
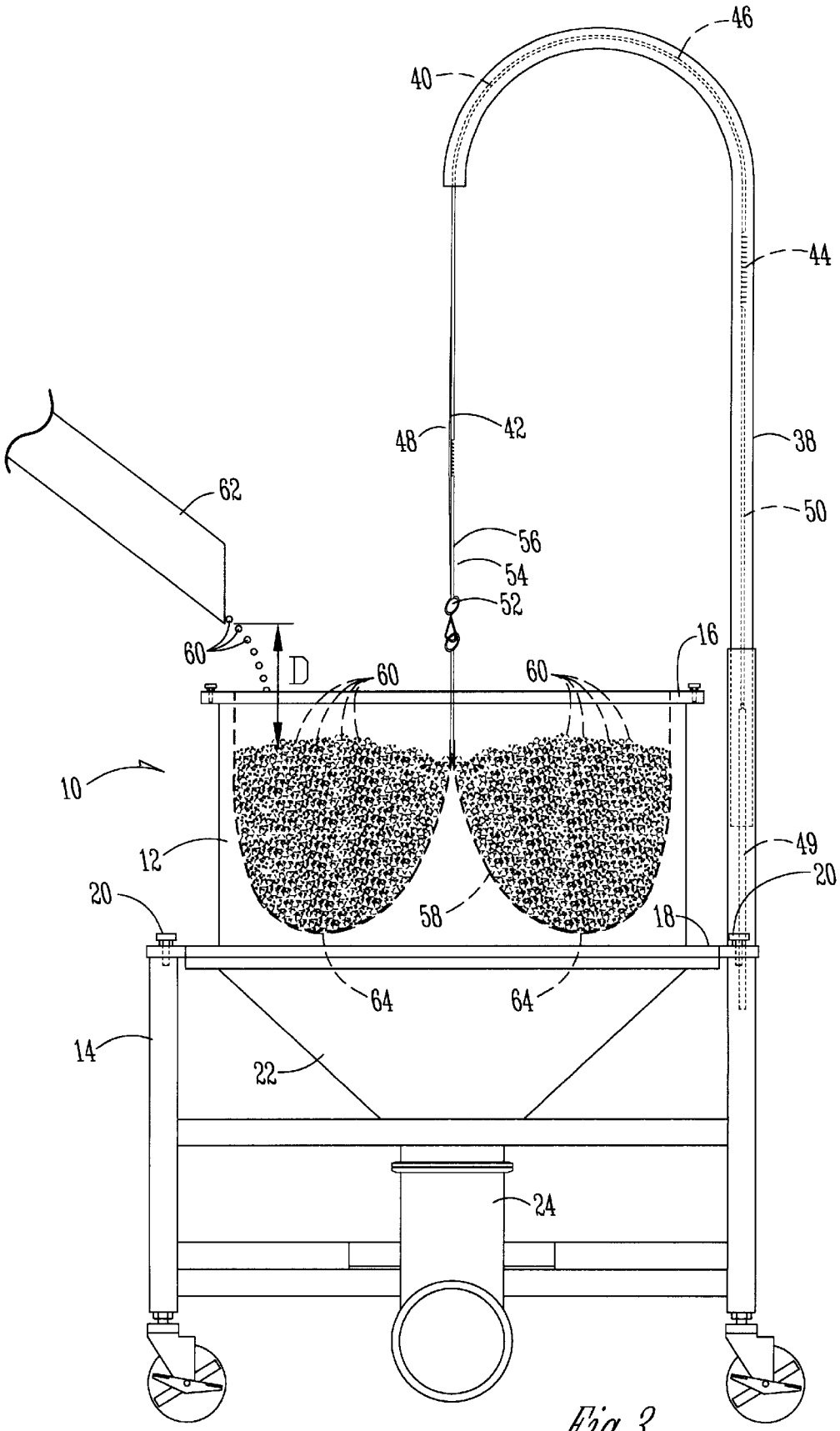
FIG. 3 is a view similar to FIG. 1 showing the bag in a substantially fully loaded lower position.

The center of the bag 30 is connected to a suspension system, shown in FIGS. 1–3. The suspension system includes a tube or conduit 38 extending upwardly from the frame 14 and terminating in a curved end 40 centrally positioned over the drum 12. The suspension system also includes one or more springs 42, 44 with a line or cable 46 extending between the springs. Preferably, spring 42 is a lightweight spring and spring 44 is a heavyweight spring. Thus, lightweight spring 42 is extended in response to a load in the bag 30 before the heavyweight spring 44 is extended. A safety line 48 is provided to prevent deformation of the spring 42 beyond its normal elasticity. A rod 49 and an anchoring cable 50 extend between the frame 14 and spring 44. The rod 49 is slidably secured to the frame 14 and fixed by a set screw 51 (FIG. 4) so that effective length of the suspension systems is adjustable. Alternatively, the rod 49 may be threadably mounted on the frame 14. As a further alternative, the cable 50 may be adjustably connected to the frame 14 through a turnbuckle or the like so that the length of the cable 50 can be adjusted. Either of spring 42 or 44 may be eliminated or additional springs may be provided in the suspension system. The suspension system also includes a cord 52 extending upwardly from the center of the bag 30 with a loop or ring 54 to which a hook 56 can be fastened such that the center of the bag is supported by the suspension system.

Thus, the suspension system supports the bag 30 between an empty raised position, as shown in FIG. 1 and a loaded lower position shown in FIG. 3. The raised center portion of the bag 30 defines a perimeter trough 58 for receiving tablets 60 from the chute 62 of a tablet press (not shown).

In operation, the tablets 60 are discharged from the tablet press chute 62 and dropped a distance D into the trough 58 of the bag 30. As additional tablets are received in the bag 30, the weight thereof initially extends the lightweight spring 42, thereby lowering the center of the bag 30 and thus increasing the depth of the trough 58. When the safety line 48 becomes taunt, spring 44 extends in response to additional loading of tablets into the bag 30. While the depth of the trough 58 of the bag 30 increases in response to the weight of the tablets 60 in the bag, the distance D that the tablets drop from the chute 62 into the bag 30 remains constant due to the resilient suspension system. Accordingly, damage to soft fragile tablets from collision with one another or the bag is minimized.

After the bag 30 is fully loaded, the hook 56 can be detached from the ring 54, and the lid 26 of the drum 12 can be secured. Conditioned air can then be forced through the air duct 24 and through the porous bag 30 for treating the tablets, as is well known in the art, so as to harden the tablets. Different bags having varying porosity may be interchanged in accordance with different treatment process requirements.

After the treatment process is complete, the conical section 22 can be removed from the lower flange 18 of the drum 12 to provide access to the bottom of the bag 30. The bag 30 includes one or more flaps 64 which can be opened to discharge the tablets 60 from the bag 30. Preferably, the flaps 64 are maintained in a closed position by Velcro, though other conventional means can be utilized for opening and closing the flaps 64.

In order to facilitate distribution of the tablets around the trough 58 of the bag 30, several different options may be utilized. For example, the chute 62 of the tablet press can be swiveled to disperse the tablets into the trough 58. Alternatively, the drum 12 can be rotated such that the tablets are received 360° around the trough 58. Such rotation of the drum, alone or with the frame 14, can be achieved with any convenient means, such as a turntable. Another alternative is to mount the upper perimeter cuff 32 and ring 34 of the bag for rotation around the upper flange 16. In this case, the thumbscrews 36 would not be utilized. Such rotation can be achieved in any convenient manner, such as a driven gear meshed with teeth on the ring 34.

The present invention will be described as it applies to its preferred embodiment. It is not intended that the present invention be limited to the described embodiment. It is intended that the invention covers all alternatives, modifications, and equivalencies which may be included within the spirit and scope of the invention.

The preferred embodiment of the present invention has been set forth in the drawings, specification, and although specific terms are employed, these are used in a generic or descriptive sense only and are not used for purposes of limitation. Changes in the form and proportion of parts as well as in the substitution of equivalents are contemplated as circumstances may suggest or render expedient without departing from the spirit and scope of the invention as further defined in the following claims.

What is claimed is:

1. A receptacle for receiving tablets from a tableting machine, comprising:

a drum having an open upper end;

a soft bag having an open upper end secured to the upper end of the drum such that the bag is extendable into the drum for receiving tablets; and a support attached to the bag for moving a portion of the bag between a raised position and a lowered position so as to vary the depth of the bag within the drum.

2. The receptacle of claim 1 wherein the support includes a spring for resiliently supporting the bag.

3. The receptacle of claim 1 wherein the support is attached to a central bottom portion of the bag, the central bottom portion of the bag extending above the upper end of the drum when in the raised position so as to define an annular trough adjacent the upper end of the drum for receiving tablets.

4. The receptacle of claim 1 wherein the support is extensible so as to move the bag from the raised position to the lowered position.

5. The receptacle of claim 1 wherein the support includes a tube extending over the drum, at least one spring positioned within the tube, and a line having a first end attached to the bag and a second end attached to the spring, whereby upon the loading of tablets into the bag, the increasing weight of the tablets gradually extends the spring so as to gradually lower the bag into the drum, thereby maintaining a substantially constant tablet drop distance between the tableting machine and the bag.

6. The receptacle of claim 1 wherein the bag is removably mounted on the drum.

7. The receptacle of claim 1 wherein the bag has an upper perimeter edge with a ring secured thereto, the ring being mateably engageable to the upper end of the drum for securement thereto.

8. The receptacle of claim 1 wherein the upper edge of the bag has a pocket into which the ring is fit.

9. The receptacle of claim 1 wherein the bag is porous.

10. The receptacle of claim 1 wherein the bag includes a flap moveable between a normally closed position and an open position for removing tablets from the bag.

11. A method of handling tablets, comprising:

discharging tablets from a tableting press;

receiving the discharged tablets in a bag supported within a drum at a preset depth; and increasing the depth of the bag in the drum as additional tablets are received in the bag, thereby maintaining a constant tablet drop distance between the tableting press and the bag.

12. The method of claim 11 wherein the lowering of the bag is automatic.

13. The method of claim 11 wherein the lowering of the bag is in response to the weight of the tablets in the bag.

14. The method of claim 11 further comprising supporting a central portion of the bag above a perimeter edge of the bag to define an annular trough for receiving the tablets, the trough having a depth which increases as tablets are received therein.

15. The method of claim 11 wherein the depth of the bag is increased by lowering a portion of the bag relative to a fixed portion of the bag.

16. The method of claim 11 wherein the bag includes an open upper perimeter, the method further comprising adjustably suspending a central portion of the bag above the upper perimeter of the bag.

17. The method of claim 11 further comprising rotating the bag during receipt of tablets so as to distribute the tablets in the bag.

18. The method of claim 1 further comprising vibrating the bag to distribute tablets in the bag.

19. The method of claim 11 further comprising rotating the drum to distribute tablets around the bag.

20. The method of claim 11 further comprising opening a flap on the bag to remove tablets therefrom.

* * * * *